US010834969B2

(12) United States Patent
Godfrey et al.

(10) Patent No.: US 10,834,969 B2
(45) Date of Patent: Nov. 17, 2020

(54) ELECTRONIC SMOKING DEVICE WITH RESERVOIR DETECTION ELEMENT

(71) Applicant: Fontem Holdings 2 B.V., Amsterdam (NL)

(72) Inventors: Sophia Godfrey, Cambridge (GB); Simon James Smith, Cambridge (GB)

(73) Assignee: Fontem Holdings 2 B.V., Amsterdam (NL)

( * ) Notice: Subject to any disclaimer, the term of this patent is extended or adjusted under 35 U.S.C. 154(b) by 158 days.

(21) Appl. No.: 15/756,414

(22) PCT Filed: Aug. 24, 2016

(86) PCT No.: PCT/EP2016/069917
§ 371 (c)(1),
(2) Date: Feb. 28, 2018

(87) PCT Pub. No.: WO2017/036865
PCT Pub. Date: Mar. 9, 2017

(65) Prior Publication Data

US 2018/0242638 A1 Aug. 30, 2018

(30) Foreign Application Priority Data

Aug. 28, 2015 (EP) ..... 15182997

(51) Int. Cl.
*A24F 13/00* (2006.01)
*A24F 17/00* (2006.01)
(Continued)

(52) U.S. Cl.
CPC ..... *A24F 47/008* (2013.01); *H05B 1/0297* (2013.01)

(58) Field of Classification Search
CPC ..... A24F 47/008; H05B 1/0297
(Continued)

(56) References Cited

U.S. PATENT DOCUMENTS 10,028,531 B2 * 7/2018 Clements ..... A61M 15/06
2013/0255702 A1 * 10/2013 Griffith, Jr. ..... A24F 47/008 131/328

(Continued)

FOREIGN PATENT DOCUMENTS

CN 103491814 A 1/2014
CN 204426687 U 7/2015

(Continued)

*Primary Examiner* — Abdullah A Riyami
*Assistant Examiner* — Thang H Nguyen
(74) *Attorney, Agent, or Firm* — Dykema Gossett PLLC

(57) ABSTRACT

An electronic smoking device (10) is provided that comprises a power supply/atomizer portion (12), a replaceable liquid reservoir portion (14), a liquid reservoir portion detection element (50) that is moveable between a first position and a second position, and an activation element (54) that is adapted to be operated by the liquid reservoir portion detection element when the latter is moved from the first position to the second position. The liquid reservoir portion comprises a cavity (46) and an engaging element (48) that partially blocks an opening of the cavity. The engaging element is adapted to engage with the liquid reservoir portion detection element during a process of coupling the portions (12, 14) so that the liquid reservoir portion detection element is moved toward the second position, thereby operating the activation element.

15 Claims, 4 Drawing Sheets

(51) Int. Cl.

| | |
|---|---|
| ***A24F 25/00*** | (2006.01) |
| ***A24F 47/00*** | (2020.01) |
| ***H05B 1/02*** | (2006.01) |

(58) Field of Classification Search
USPC ..... 131/329, 328
See application file for complete search history.

(56) References Cited

U.S. PATENT DOCUMENTS

| | | | | |
|---|---|---|---|---|
| 2014/0261408 | A1* | 9/2014 | DePiano | H05B 3/04 128/202.21 |
| 2014/0261487 | A1* | 9/2014 | Chapman | A24F 47/008 131/328 |
| 2015/0245662 | A1* | 9/2015 | Memari | H05K 999/00 131/328 |
| 2016/0262451 | A1* | 9/2016 | Liu | A24F 47/008 |
| 2017/0360092 | A1* | 12/2017 | Althorpe | F22B 1/284 |
| 2017/0367407 | A1* | 12/2017 | Althorpe | A61M 15/06 |
| 2018/0116284 | A1* | 5/2018 | Biel | A24F 47/008 |

FOREIGN PATENT DOCUMENTS

| | | | |
|---|---|---|---|
| CN | 204466906 | U | 7/2015 |
| DE | 202014001717 | U1 | 7/2015 |
| WO | 2013/113173 | A1 | 8/2013 |
| WO | 2014110119 | A1 | 7/2014 |
| WO | 2014/140087 | A1 | 9/2014 |
| WO | 2015108816 | A2 | 7/2015 |

* cited by examiner

ELECTRONIC SMOKING DEVICE WITH RESERVOIR DETECTION ELEMENT

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an airflow pattern through the device). The airflow sensor indicates or signals the puff to the control electronics to power up the device and generate vapor. In other e-cigarettes, a switch is used to power up the e-cigarette to generate a puff of vapor.

In order to ensure that no harmful vaporization products are created in case an above sketched dose delivery mechanism of the electronic smoking devices runs dry, it is important to timely replace an empty liquid reservoir.

SUMMARY OF THE INVENTION

In accordance with one aspect of the present invention there is provided an electronic smoking device comprising a power supply/atomizer portion and a replaceable liquid reservoir portion which is coupleable with the power supply/atomizer portion. The liquid reservoir portion comprises a liquid reservoir storing a liquid. The power supply/atomizer portion comprises a power supply and an atomizer adapted to atomize the liquid stored in the liquid reservoir when operated by the power supply. The electronic smoking device further comprises a liquid reservoir portion detection device including, in the power supply/atomizer portion, a liquid reservoir portion detection element that is moveable between a first position and a second position, and an activation element that is adapted to be operated by the liquid reservoir portion detection element when the liquid reservoir portion detection element is moved from the first position to the second position. The liquid reservoir portion detection device further includes, in the liquid reservoir portion, a cavity and an engaging element. The cavity is empty and an opening of the cavity that faces the power supply/atomizer portion when the liquid reservoir portion is coupled with the power supply/atomizer portion is at least partially blocked by the engaging element as long as the liquid reservoir portion is not coupled with the power supply/atomizer portion. The cavity is adapted to receive at least part of the liquid reservoir portion detection element and the engaging element is adapted to engage with the liquid reservoir portion detection element when the liquid reservoir portion is coupled with the power supply/atomizer portion. The liquid reservoir portion detection element is adapted, when the liquid reservoir portion is coupled with the power supply/atomizer portion, to engage with the engaging element so as to be moved from the first position to the second position, thereby operating the activation element.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
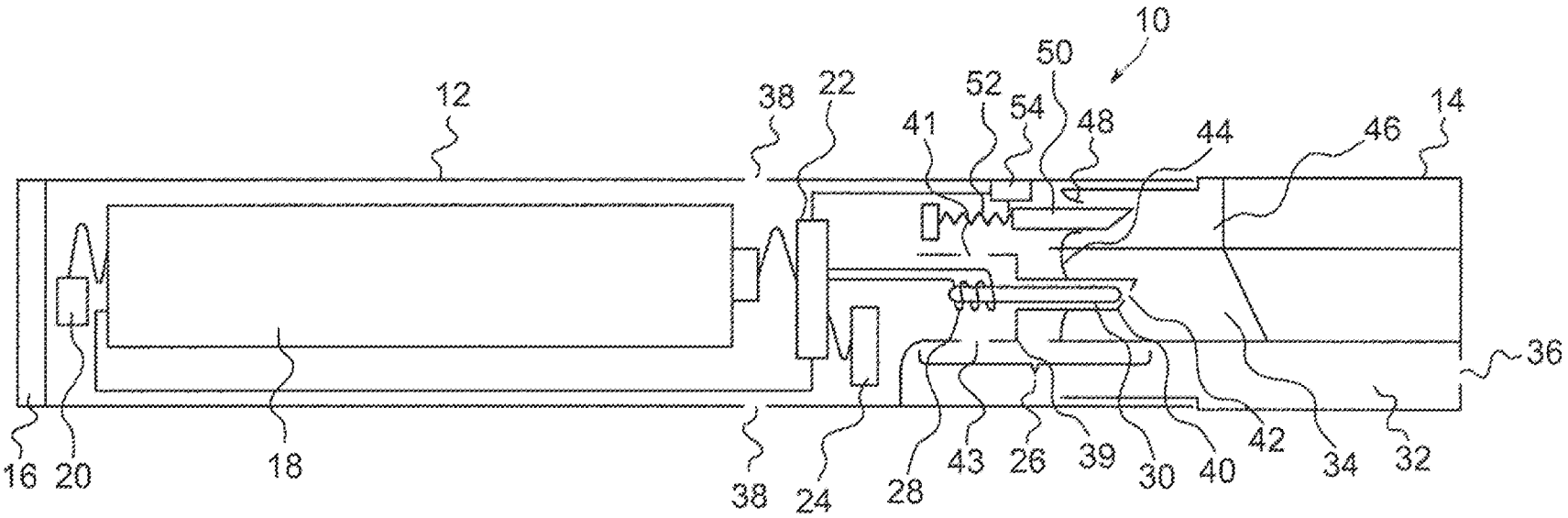
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 typically has a housing comprising a cylindrical hollow tube having an end cap 16. In FIG. 1, the cylindrical hollow tube is shown as a two-piece structure having a power supply/atomizer portion 12 and a liquid reservoir portion 14. Together the power supply/atomizer portion 12 and the liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 20 mm.

The power supply/atomizer portion 12 and liquid reservoir portion 14 are typically made of metal, e.g. steel or aluminum, ceramic, or of hardwearing plastic and act together with the end cap 16 to provide a housing to contain the components of the e-cigarette 10. The power supply/atomizer portion 12 and a liquid reservoir portion 14 may be configured to fit together by a friction push fit, a snap fit, or a bayonet attachment, magnetic fit, or screw threads. The end cap 16 is provided at the front end of the power supply/atomizer portion 12. The end cap 16 may be made from translucent plastic or other translucent material to allow an LED 20 positioned near the end cap to emit light through the end cap. The end cap can be made of metal or other materials that do not allow light to pass. One or more additional LEDs can be provided, e.g. centrally on the electronic smoking device. Light emitted therefrom can transmit through thin walled sections of plastic that form part of the housing.

An air inlet may be provided in the end cap, at the edge of the inlet next to the cylindrical hollow tube, or anywhere along the length of the cylindrical hollow tube. FIG. 1 shows a pair of air inlets 38 provided approximately in the middle the cylindrical hollow tube.

A battery 18, one or more light-emitting diodes (LED) 20, control electronics 22 and optionally an airflow sensor 24 are provided within the cylindrical hollow tube power supply/atomizer portion 12. The battery 18 is electrically connected to the control electronics 22, which are electrically connected to the LED 20 and the airflow sensor 24. In this example the LED 20 is at the front end of the power supply/atomizer portion 12, adjacent to the end cap 16, and the control electronics 22 and airflow sensor 24 are provided in the central cavity at the other end of the battery 18 adjacent the liquid reservoir portion 14.

The airflow sensor 24 acts as a puff detector, detecting a user puffing or sucking on the liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The airflow sensor 24 shown in FIG. 1 is configured to detect a pressure drop in the electronic smoking device, caused by a user puffing on the smoking device, and to provide a respective pressure drop signal to the control electronics 22. The pressure drop signal includes duration information specifying the duration of the pressure drop, i.e. the duration of the puff. According to a preferred embodiment, in order to implement the airflow sensor 24, an ASIC design is used and a pressure drop across two circular faces (not shown in detail in FIG. 1) of the airflow sensor 24 produces a binary digital output signal. The output state of the signal remains unchanged for the duration of the pressure drop. Consequently, the control electronics 22, which is generally configured to determine the duration of a puff based on the pressure drop signal provided by the airflow sensor 24, can measure the duration of the puff by simply measuring the duration of the output signal indicating the pressure drop.

When a puff is detected by the airflow sensor 24, as described below in more detail, the control electronics 22 causes the battery 18 to supply power to the atomizer 26. Based on the information regarding the duration of the puff, the control electronics 22 can therefore also control the duration of the power supply to the atomizer 26, namely according to the duration of the puff.

The control electronics 22 is generally configured to increment and store a puff or dose counter. By means of a puff or dose counter, according to a simple embodiment, the number of puffs executed by a user of the e-cigarette 10 can be counted. According to a preferred embodiment, however, not only the number of puffs, but the sum of the duration of puffs, i.e. the total puffing time, is determined by the control electronics 22 and stored in a non-volatile memory of the power supply/atomizer portion 12. I.e. a preferred embodiment of a dose counter does not only store the number of puffs, but stores the total puffing time. Based on the specific pressure drop signal provided by the airflow sensor 24, which signal also provides information regarding the duration of the pressure drop, i.e. information regarding the duration of the puff that causes the respective pressure drop, the control electronics 22 can keep track of the total puffing time, i.e. the sum of the duration of the puffs executed by a user of the e-cigarette 10, and can update and store the respective value accordingly.

Information concerning the total puffing time, which can be stored in non-volatile memory of the control electronics 22, can be used to determine both when a replacement of the liquid reservoir 34 is necessary (because the liquid reservoir 34 is close to being empty), and also when the power supply/atomizer portion 12 has reached its service life. Preferably, two different puff or dose counters are used in order to handle these two aspects. A first dose counter indicating the necessity to replace the liquid reservoir 34 can be reset once the replacement of the liquid reservoir 34 and the insertion of a new, intact liquid reservoir portion 14 have been detected as described hereinafter in detail with respect to the liquid reservoir portion detection device. Further, a second dose counter can be provided that is adapted to measure the total puffing time over the service life of the power supply/atomizer portion 12.

The control electronics 22 are also connected to the atomizer 26. In the example shown, the atomizer 26 includes a heating coil 28 which is wrapped around a wick 30 extending inside an elongate piercing portion 40 which forms part of an atomizer body 39. The piercing portion 40 is adapted to pierce a foil 44 which covers a liquid reservoir 34 when the liquid reservoir portion 14 is coupled with the power supply/atomizer portion 12 as described in detail hereinafter with reference to FIGS. 2A to 2C. A tip portion of the piercing portion 40 includes an opening 42. Through this opening 42 liquid from the liquid reservoir 34 can enter the piercing portion 40 of the atomizer body 39 and can be drawn into by the wick 30. The wick 30 may be a porous material such as a bundle of fiberglass fibers, with liquid from the liquid reservoir 34, through the opening 42 of the piercing portion 40, drawn by capillary action from one end of the wick 30 towards the other end portion of the wick 30 encircled by the heating coil 28. The wick 30 and the heating coil 28 do not completely block the interior of the atomizer body 39. Rather an air gap is provided on one or both sides of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

An air inhalation port 36 is provided at the back end of the liquid reservoir portion 14 remote from the end cap 16. The inhalation port 36 may be formed from the cylindrical hollow tube liquid reservoir portion 14 or maybe formed in an end cap.

In use, a user sucks on the e-cigarette 10. This causes air to be drawn into the e-cigarette 10 via one or more air inlets, such as air inlets 38, and to be drawn through openings 41, 43 of the atomizer body 39 and an air duct 32 in the liquid reservoir portion 14 toward the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the atomizer body 39. As the user continues to suck on the e-cigarette 10, this aerosol is drawn through the vapor exit opening 43 and the air duct 32 and inhaled by the user. At the same time the control electronics 22 also activate the LED 20 causing the LED 20 to light up which is visible via the translucent end cap 16 mimicking the appearance of a glowing member at the end of a conventional cigarette. Alternatively, activating the LED 20 can be omitted. As liquid present in the wick 30 is converted into an aerosol more liquid is drawn into the wick 30 from the liquid reservoir 34 by capillary action and thus is available to be converted into an aerosol through subsequent activation of the heating coil 28.

Of course, in addition to the above description of the structure and function of a typical e-cigarette 10, variations also exist. For example, the LED 20 or the LEDs puff feedback may be omitted. The airflow sensor 24 may be placed at any point along the length of the power supply/atomizer portion 12 rather than in the middle of the e-cigarette and the air inlet hole 38 can be located on either side of the airflow sensor location. The airflow sensor 24 may be replaced with a push button or switch which enables a user to activate the e-cigarette manually rather than in response to the detection of a change in airflow or air pressure. Based on how long the user presses the push button or switch, the control electronics 22 can therefore also control the duration of the power supply to the atomizer 26, namely according to the duration of the activation of the switch or push down button.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2A:
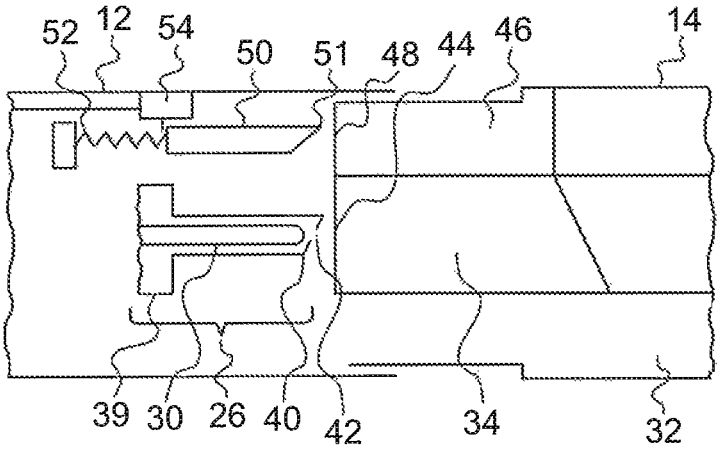
FIGS. 2A to 2C are schematic cross-sectional illustrations illustrating a process of coupling a power supply/atomizer portion and a liquid reservoir portion of the e-cigarette of FIG. 1 at three different states.
Figure 2B:
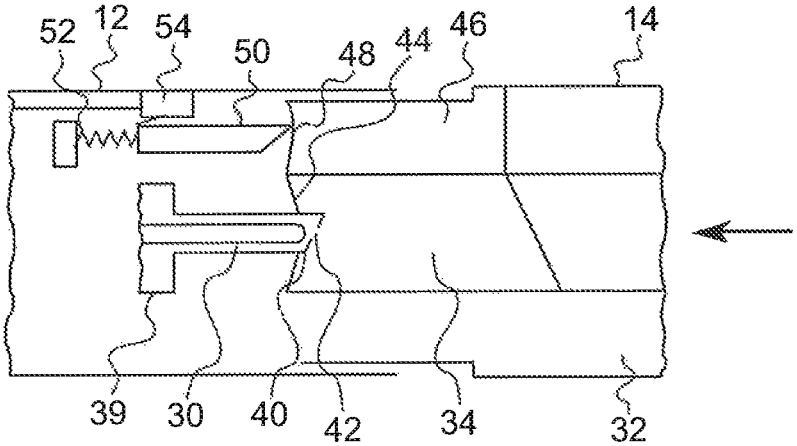
Figure 2C:
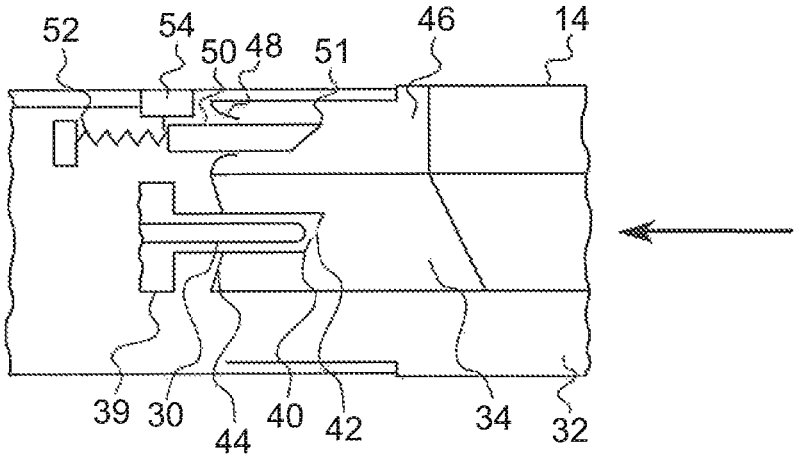

Some e-cigarettes are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable or replaceable. In the cases where the liquid reservoir 34 is a toroidal cavity, this may be achieved by refilling the liquid reservoir 34 via a refill port. In other embodiments, e.g. in the embodiment in FIG. 1, the liquid reservoir portion 14 of the e-cigarette 10 is detachable from the power supply/atomizer portion 12 and a new liquid reservoir portion 14 with a new liquid reservoir 34 can be coupled to the power supply/atomizer portion 12, as shown in FIGS. 2A to 2C, thereby replenishing the supply of liquid.

The liquid reservoir portion 14 shown in FIG. 1 includes a liquid reservoir 34 that is provided to extend in longitudinal direction of the liquid reservoir portion 14. An opening of the liquid reservoir 34 is covered by a foil 44. This foil 44 can be heat-sealed to the liquid reservoir portion 14. When the liquid reservoir portion 14 is coupled with the power supply/atomizer portion (cf. FIG. 2A, 2B), the foil 44 is pierced by the piercing portion 40 of the atomizer 26.

The liquid reservoir portion 14 further includes a cavity 46. In the exemplary embodiment in FIG. 1, the cavity 46 is provided on one side of the liquid reservoir 34 and also extends in longitudinal direction of the liquid reservoir portion 14. The cavity is empty and an opening of the cavity 46 which faces the power supply/atomizer portion 12 when the liquid reservoir portion 14 is coupled to the power supply/atomizer portion 12 is at least partially blocked by an engaging element 48 as long as the liquid reservoir portion 14 is not coupled with the power supply/atomizer portion 12 (cf. FIG. 2A, 2B). Structure and function of the cavity 46 and the engaging element 48, which both form part of a liquid reservoir portion detection device, will be described hereafter with reference to FIG. 2A to 2C.

Further, an air duct 32 is provided in the liquid reservoir portion 14. In the example shown in FIG. 1, the air duct 32 is provided on the other side of the liquid reservoir 34, opposite to the side on which the cavity 46 is provided. Also the air duct 32 extends in longitudinal direction of the liquid reservoir portion 14 toward the inhalation port 36. Of course, the relative position of the liquid reservoir 34 with respect to the air duct 32 and/or the cavity 46 can vary.

In the power supply/atomizer portion 12 a liquid reservoir portion detection element 50 and an activation element 54 are provided. The liquid reservoir portion detection element 50, which is shown in the form of a pin in FIG. 1, is moveable between a first default position (cf. FIG. 2A, 2C) and a second, pushed back position (cf. FIG. 2B). The activation element 54, which can be configured as a simple micro switch, is adapted to be operated by the liquid reservoir portion detection element 50 when the liquid reservoir portion detection element 50 is moved from the first position to the second position (cf. FIG. 2A, 2B). A resilient element 52, e.g. a spring, is adapted to push the liquid reservoir portion detection element 50 toward of the first position. The resilient element 52 is coupled with the liquid reservoir portion detection element 50. The resilient element 52, the liquid reservoir portion detection element 50, and the activation element 54 also form part, on the side of the power supply/atomizer portion 12, of the above mentioned liquid reservoir portion detection device, which will now be described in detail with reference to FIG. 2A to 2C.

The liquid reservoir portion detection device 48, 50, 52, 54 serves to detect, in the power supply/atomizer portion 12, the coupling of a new, intact liquid reservoir portion 14 with the power supply/atomizer portion 12. In an e-cigarette according to FIG. 1, a liquid reservoir portion 14 has to be replaced by a new liquid reservoir portion 14 in case the liquid reservoir 34 becomes empty. As described below, a coupling of a new, intact liquid reservoir portion 14 with the power supply/atomizer portion 12 can simply and reliably be detected.

As shown in FIG. 2A, a liquid reservoir portion with the empty liquid reservoir has already been removed from the power supply/atomizer portion 12. A new, intact liquid reservoir portion 14 is provided. An opening of the respective liquid reservoir 34 that faces the power supply/atomizer portion 12 is covered by the foil 44 and the opening of cavity 46 at the same end of the liquid reservoir portion 12 is blocked by means of the engaging element 48. In the example in FIG. 2A to 2C, the engaging element 48 is a cover element that completely covers the opening of the cavity 46. Other preferred embodiments of engaging elements are described hereinafter with reference to FIGS. 3 to 5, which alternative engaging elements do e.g. not completely cover the opening of the cavity 46 but only partly block the respective opening.

As illustrated in FIG. 2B, while coupling the new liquid reservoir portion 14 with the power supply/atomizer portion 12, the liquid reservoir portion 14 is slidably fitted onto the power supply/atomizer portion 12. As a coupling interface, a simple push fit is used in the example. Alternative ways of coupling the respective portions 12, 14 have already been mentioned above. A one way design of the interface, which can be seen from FIGS. 2A to 2C, facilitates the coupling process and helps to prevent misalignment of the power supply/atomizer portion 12 and the liquid reservoir portion 14.

While pushing the liquid reservoir portion 14 onto the power supply/atomizer portion 12 (as indicated by the arrow in FIG. 2B), on the one hand, as already mentioned above, the piercing portion 40 of the atomizer 26 pierces the foil 44 that covers the liquid reservoir 34. On the other hand, the liquid reservoir portion detection element 50 of the power supply/atomizer portion 12 contacts and engages with the engaging element 48 of the liquid reservoir portion 14. The engaging element 48 is basically configured to be destructible upon a pressure load applied by the liquid reservoir portion detection element 50, which pressure load is above a predetermined value. Due to that fact, however, that the engaging element 48 is adapted, before being destructed, to withstand a pressure load that is exerted by the liquid reservoir portion detection element 50, which pressure load is sufficiently high so as to move the liquid reservoir portion detection element 50 from the first position toward the second position against the pressure load provided by the resilient element 52, the liquid reservoir portion detection element 50 is moved from the first, default position (cf. FIG. 2A, in which the resilient 52 element is essentially stress-free) to the second, pushed back position (cf. FIG. 2B, in which the resilient element 52 is at least partially compressed). While being moved from the first position to the second position, the liquid reservoir portion detection element 50 operates the activation element 54. An activation signal generated by the activation element 54 indicates the coupling of a new, intact liquid reservoir portion 14. This activation signal can be processed by the control electronics 22. In order to indicate the coupling to a user of the smoking device, the control electronics 22 can cause the LED 20 or a further LED (not shown) to light up according to a predetermined illuminating pattern. In particular, the control electronics 22, when receiving the activation signal, can reset the first dose counter that actually stores the puffing time since the most recent replacement of a liquid reservoir portion.

According to a preferred embodiment, the control electronics 22 is configured to temporarily deactivate the e-cigarette 10 when the first dose counter that stores the puffing time since the most recent replacement of a liquid reservoir portion 34, exceeds a first predefined threshold value. This ensures that the risk of harmful vaporizations products is mitigated which may occur in case the atomizer 26 runs dry. By coupling a new liquid reservoir portion 14 to the power supply/atomizer portion 12, thereby providing new liquid, the respective dose counter can be reset as described above.

According to another preferred embodiment, the control electronics 22 is configured to permanently deactivate the e-cigarette 10 when the second dose counter that stores total puffing time, i.e. the puffing time since the bringing into service of the power supply/atomizer portion 12, exceeds a second predefined threshold value. This ensures that the risk of harmful vaporizations products is mitigated which may also occur when the atomizer 26 has been used for a long time (i.e. longer than the second predefined threshold).

Both the first and the second dose counters can be implemented in software.

When the new liquid reservoir portion 14 is finally fitted onto the power supply/atomizer portion 12 (as indicated by the arrow in FIG. 2C), the engaging element 48 is destructed upon further engagement with the liquid reservoir portion detection element 50 and the respective pressure load applied by liquid reservoir portion detection element 50. In the illustrated example in FIG. 2A to 2C, the liquid reservoir portion detection element 50 is a pin having a tip portion 51 which is adapted to pierce, and thereby destruct the cover element 48 during the coupling of the liquid reservoir portion 14 with the power supply/atomizer portion 12. Because the destructed engaging element 48 can no longer withstand the pressure load provided by the resilient element 52, the liquid reservoir portion detection element 50 is again moved from the second position to the first, default position (cf. FIG. 2C). In this position, the liquid reservoir portion detection element 50 is prepared to detect the coupling of a new, intact liquid reservoir portion 14 to the power supply/atomizer portion 12. In the state, in which the liquid reservoir portion 14 is coupled to the power supply/atomizer portion 12, the liquid reservoir portion detection element 50 extends into the formerly empty cavity 46 of the liquid reservoir portion 14. In other words, in the coupled state, the cavity 46 receives at least part of the liquid reservoir portion detection element 50.

Due to the fact that the engaging element 48 is destructed in the final phase of the coupling process, after the activation signal has been generated by the activation element 54, an erroneous reuse of an old liquid reservoir portion 14, i.e. a liquid reservoir portion 14 with an empty or at least already opened liquid reservoir 34, can indirectly be prevented. This is because in an old, i.e. pre-used liquid reservoir portion 14 the engaging element 48 is already destructed. Consequently, when coupling such a pre-used liquid reservoir portion 14 to the power supply/atomizer portion 12, the liquid reservoir portion detection element 50 is not moved from the first position to the second position—due to that lack of a respective intact engaging element 48—, the activation element 54 is not operated, no activation signal is generated and the first dose counter that stores the puffing time since the most recent replacement of a liquid reservoir portion 14 is not reset. As soon as this first dose counter exceeds the above mentioned first predefined threshold, the e-cigarette 10 will temporarily be deactivated, thereby indirectly indicating that the recently coupled liquid reservoir portion 14 was not a new, intact liquid reservoir portion 14. In addition, a destructed engaging element 48, e.g. a pierced cover element, can readily be recognized by the user, and also in this way prevent a potential reuse of a liquid reservoir portion 14.

Figure 3:
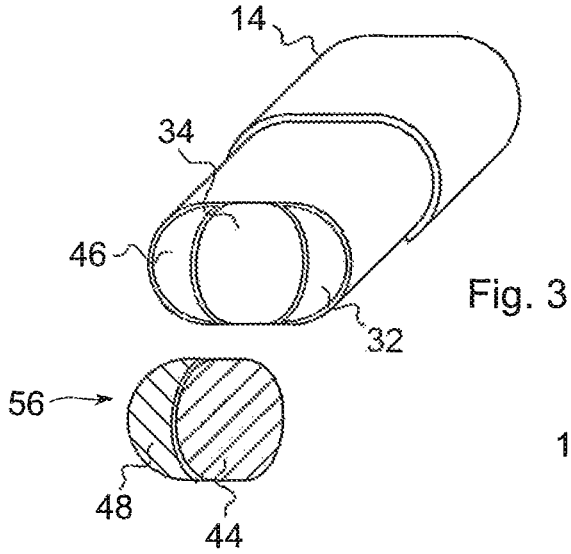
FIG. 3 is a schematic perspective illustration of an exemplary liquid reservoir portion according to a first embodiment.

FIG. 3 is a schematic perspective illustration of an exemplary liquid reservoir portion 14 according to a first embodiment. In the Figure, a combined foil element 56 is shown. This foil element 56, which is intended to be heat-sealed onto the liquid reservoir portion 14, includes a first foil element 44 that is adapted to cover and seal the liquid reservoir portion 34 and a second foil element 48 that is adapted to cover the opening of the cavity 46. The air duct 32, which ends in the inhalation port 36 (cf. FIG. 1), remains uncovered. According to this configuration, the exposure of the liquid to possible contaminants is significantly reduced as the liquid is only in contact with the material of the liquid reservoir portion 14 and the cover foil 44. The fact that a cover foil 48 can be used as an engaging element in the context of a liquid reservoir portion detection device has already been described above.

Figure 4:
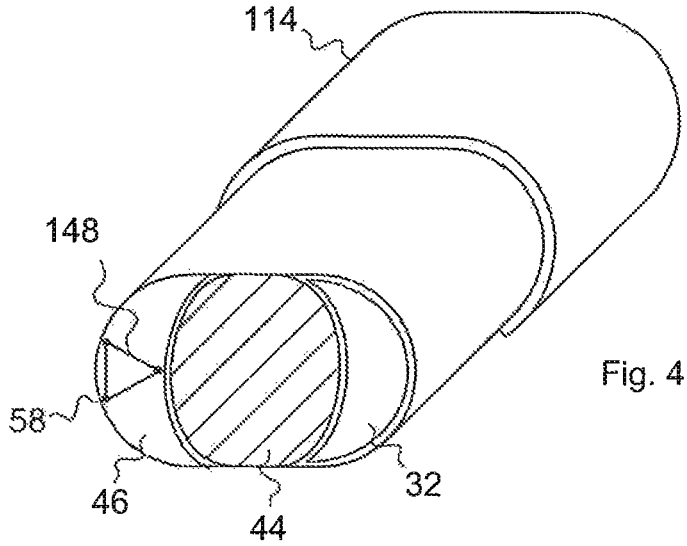
FIG. 4 is a schematic perspective illustration of an exemplary liquid reservoir portion according to a second embodiment.

FIG. 4 is a schematic perspective illustration of an exemplary liquid reservoir portion 114 according to a second embodiment. In contrast to the embodiment shown in FIG. 3, the engaging element 148 is configured as a small plate which is fixed to the boundary of the opening of the cavity 46 by means of three predetermined breaking points 58. The plate 148 and the connection to the boundary of the opening via the predetermined breaking points 58 are configured, on the one hand, to withstand a pressure load that is exerted by the liquid reservoir portion detection element 50, e.g. a pin according to FIG. 1, which pressure load is sufficiently high so as to move the liquid reservoir portion detection element 50 from the first position toward the second position against the pressure load provided by the resilient element 52. On the other hand, the connection is configured to break, resulting in a destructed engaging element 148, in the final phase of coupling the respective liquid reservoir portion 114 with a power supply/atomizer portion 12 as described with respect to FIG. 2C. Of course, the geometric form (triangle) and the number of predetermined breaking points 58 can vary, as long as the plate 148 functions as an engaging element as generally described above with reference to FIGS. 2A to 2C.

Figure 5A:
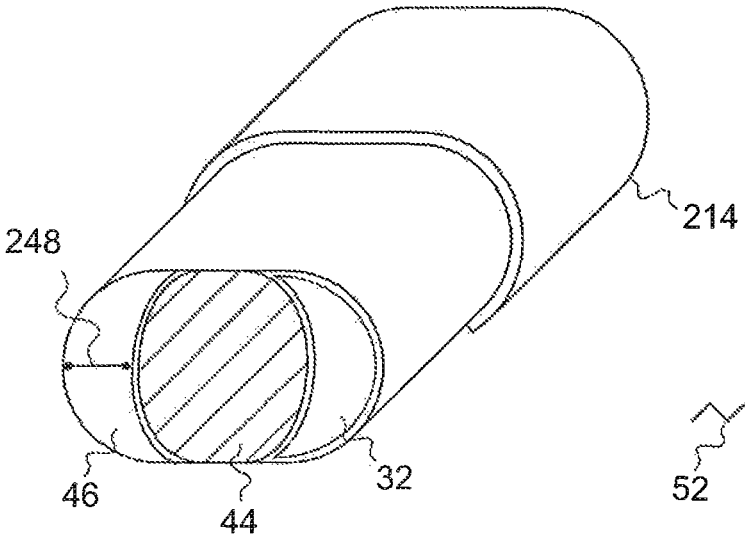
FIG. 5A is a schematic perspective illustration of an exemplary liquid reservoir portion according to a third embodiment.

FIG. 5A is a schematic perspective illustration of an exemplary liquid reservoir portion according to a third embodiment. Here, in contrast to FIG. 4, the engaging element is provided by a thread 248 which is configured to break in case a pressure load applied is too high.

Figure 5B:
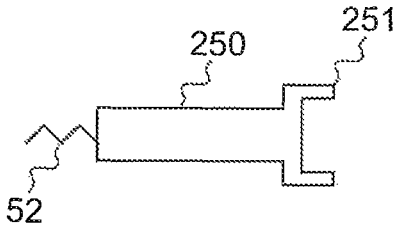
FIG. 5B is a schematic cross-sectional illustration of an exemplary liquid reservoir portion detection element according to the third embodiment.

FIG. 5B is a schematic cross-sectional illustration of an exemplary liquid reservoir portion detection element 250 according to the third embodiment. The liquid reservoir portion detection element 250 includes a hook-like end portion 251 that is adapted to engage with the tread 248 in order to move the liquid reservoir portion detection element 250, in the second phase of a connection process as described above with respect to FIG. 2B, from the first position to the second position.

Figure 6:
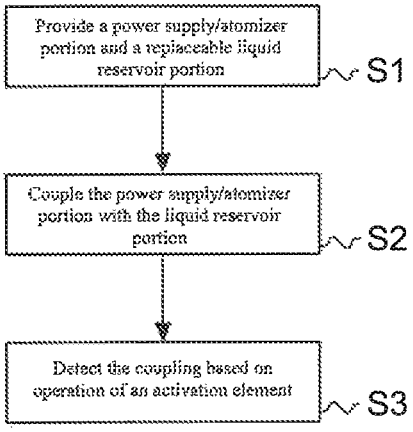
FIG. 6 illustrates steps of a method for detection the coupling of a power supply/atomizer portion and a liquid reservoir portion of an electronic smoking device.

FIG. 6 illustrates steps of a method for detecting the coupling of a power supply/atomizer portion 12 and a liquid reservoir portion 14 of an electronic smoking device 10, such as the e-cigarette described with reference to FIG. 1.

In step S1, a power supply/atomizer portion 12 and the replaceable liquid reservoir portion 14 as described in detail with respect to FIG. 1 are provided. In particular, the liquid reservoir portion 14 is adapted to be coupleable with the power supply/atomizer portion 12. The liquid reservoir portion 14 comprises a liquid reservoir 34 storing a liquid. The power supply/atomizer portion comprises a power supply 18 and an atomizer 26 adapted to atomize the liquid stored in the liquid reservoir 34 when operated by the power supply 18. The electronic smoking device 10 further comprises a liquid reservoir portion detection device 50 including, in the power supply/atomizer portion 12, a liquid reservoir portion detection element 50 that is moveable between a first position and a second position, and an activation element 54 that is adapted to be operated by the liquid reservoir portion detection element 50 when the liquid reservoir portion detection element 50 is moved from the first position to the second position. The liquid reservoir portion detection device further includes, in the liquid reservoir portion 14, a cavity 46 and an engaging element 48. The cavity 46 is empty and an opening of the cavity 46 that faces the power supply/atomizer portion 12 when the liquid reservoir portion 14 is coupled with the power supply/atomizer portion 12 is at least partially blocked by the engaging element 48 as long as the liquid reservoir portion 14 is not coupled with the power supply/atomizer portion 12. The cavity 46 is adapted to receive at least part of the liquid reservoir portion detection element 50 and the engaging element 48 is adapted to engage with the liquid reservoir portion detection element 50 when the liquid reservoir portion 14 is coupled with the power supply/atomizer portion 12. The liquid reservoir portion detection element 50 is adapted, when the liquid reservoir portion 14 is coupled with the power supply/atomizer portion 12, to engage with the engaging element 48 so as to be moved from the first position to the second position, thereby operating the activation element 54.

In step S2, the power supply/atomizer portion 12 is coupled with the liquid reservoir portion 14 as described above with reference to FIGS. 2A to 2C. While coupling the power supply/atomizer portion 12 with the liquid reservoir portion 14, the liquid reservoir portion detection element 50 of the power supply/atomizer portion 12 engages the engaging element 48 of the liquid reservoir portion 14 and is moved from the first position to the second position, thereby operating the activation element 54 (cf. FIG. 2B).

In step S3, the coupling of the respective portions 12, 14 is detected based on the operation of the activation element 54. In particular, in order to indicate a respective coupling, the activation element 54 can generate an activation signal, which signal can be further processed by suitable control electronics 22.

In summary, in one aspect the electronic smoking device comprises a power supply/atomizer portion and a replaceable liquid reservoir portion which is coupleable with the power supply/atomizer portion. The liquid reservoir portion comprises a liquid reservoir storing a liquid. The power supply/atomizer portion comprises a power supply and an atomizer adapted to atomize the liquid stored in the liquid reservoir when operated by the power supply. The electronic smoking device further comprises a liquid reservoir portion detection device including, in the power supply/atomizer portion, a liquid reservoir portion detection element that is moveable between a first position and a second position, and an activation element that is adapted to be operated by the liquid reservoir portion detection element when the liquid reservoir portion detection element is moved from the first position to the second position. The liquid reservoir portion detection device further includes, in the liquid reservoir portion, a cavity and an engaging element. The cavity is empty and an opening of the cavity that faces the power supply/atomizer portion when the liquid reservoir portion is coupled with the power supply/atomizer portion is at least partially blocked by the engaging element as long as the liquid reservoir portion is not coupled with the power supply/atomizer portion. The cavity is adapted to receive at least part of the liquid reservoir portion detection element and the engaging element is adapted to engage with the liquid reservoir portion detection element when the liquid reservoir portion is coupled with the power supply/atomizer portion. The liquid reservoir portion detection element is adapted, when the liquid reservoir portion is coupled with the power supply/atomizer portion, to engage with the engaging element so as to be moved from the first position to the second position, thereby operating the activation element. The liquid reservoir portion detection device can further comprise a resilient element in the power supply/atomizer portion, which resilient element is adapted to push the liquid reservoir portion detection element toward of the first position.

The engaging element is preferably configured to be destructed upon engagement with the liquid reservoir portion detection element when the liquid reservoir portion is coupled with the power supply/atomizer portion.

The engaging element is preferably adapted, before being destructed, to withstand a pressure load that is exerted by the liquid reservoir portion detection element, which pressure load is sufficiently high so as to move the liquid reservoir portion detection element from the first position toward the second position against the pressure load provided by the resilient element.

According to one embodiment, the engaging element is a cover element that partially or completely covers the opening of the cavity. The cover element can be a foil element. Such a foil element can be heat-sealed onto the liquid reservoir portion.

According to one embodiment, the liquid reservoir portion detection element can be configured as a pin having a tip portion which is adapted to pierce a foil element when the liquid reservoir portion is coupled with the power supply/atomizer portion.

Generally, the smoking device comprises an air duct in communication with the atomizer to guide atomized liquid toward an inhalation port of the electronic smoking device. At least part of the air duct can be provided inside the liquid reservoir portion.

The liquid reservoir can be provided to extend in longitudinal direction of the liquid reservoir portion. The cavity can be provided on one side of the liquid reservoir. The part of the air duct that is provided in the liquid reservoir portion can be provided on the other side of the liquid reservoir to also extend in longitudinal direction of the liquid reservoir portion toward the inhalation port.

The electronic smoking device can comprise an airflow sensor, and control electronics electrically connected with the activation element and the airflow sensor. The airflow sensor can be adapted to detect a user puffing on the electronic smoking device and the control electronics can be adapted to increment a dose counter based on a puff detected by the airflow sensor and to reset the dose counter when the activation element is operated.

In particular, the airflow sensor can be configured to detect a pressure drop in the electronic smoking device (the pressure drop being caused by a user puffing on the smoking device) and to provide a pressure drop signal to the control electronics, which signal includes a duration information specifying the duration of the pressure drop (i.e. the duration of the puff).

The control electronics can then be configured to determine the duration of the puff based on the pressure drop signal provided by the airflow sensor and to control power supply to the atomizer and/or to increment the dose counter according to the duration of the puff.

In another aspect, a power supply/atomizer portion for an electronic smoking device, wherein the power supply/atomizer portion is adapted to be coupled with a replaceable liquid reservoir portion for an electronic smoking device, comprises a power supply and an atomizer adapted to atomize the liquid stored in a liquid reservoir when operated by the power supply. The power supply/atomizer portion further comprises a liquid reservoir portion detection element that is moveable between a first, default position and a second, pushed back position, and an activation element. The activation element is adapted to be operated by the liquid reservoir portion detection element when the liquid reservoir portion detection element is moved from the first position to the second position.

In still another aspect, a liquid reservoir portion for an electronic smoking device, wherein the liquid reservoir portion is adapted to be replaceably coupled with a power supply/atomizer portion for an electronic smoking device, comprises a liquid reservoir storing a liquid, an empty cavity and an engaging element. An opening of the cavity that faces the power supply/atomizer portion when the liquid reservoir portion is coupled with the power supply/atomizer portion is at least partially blocked by the engaging element.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 power supply/atomizer portion
14 liquid reservoir portion
16 end cap
18 battery
20 light-emitting diode (LED)
22 control electronics
24 airflow sensor
26 atomizer
28 heating coil
30 wick
32 air duct
34 liquid reservoir
36 air inhalation port
38 air inlets
39 atomizer body
40 piercing portion of atomizer body
41 air inlet
42 opening
43 vapor exit opening
44 foil
46 cavity
48 engaging element
50 liquid reservoir portion detection element
51 tip portion
52 resilient element
54 activation element
56 combined foil element
58 predetermined breaking point
114 liquid reservoir portion
148 engaging element
214 liquid reservoir portion
248 engaging element
250 liquid reservoir portion detection element
251 hook-like end portion

The invention claimed is:

1. An electronic smoking device comprising:

a replaceable liquid reservoir portion, wherein the liquid reservoir portion comprises a liquid reservoir storing a liquid;

a power supply/atomizer portion coupleable with the replaceable liquid reservoir portion, the power supply/atomizer portion comprises a power supply and an atomizer adapted to atomize the liquid stored in the liquid reservoir when operated by the power supply; and a liquid reservoir portion detection device including:

in the power supply/atomizer portion, a liquid reservoir portion detection element that is moveable between a first position and a second position, and an activation element that is adapted to be operated by the liquid reservoir portion detection element when the liquid reservoir portion detection element is moved from the first position to the second position, in the liquid reservoir portion, a cavity and an engaging element, wherein the cavity is empty and an opening of the cavity that faces the power supply/atomizer portion when the liquid reservoir portion is coupled with the power supply/atomizer portion is at least partially blocked by the engaging element as long as the liquid reservoir portion is not coupled with the power supply/atomizer portion, wherein the cavity is adapted to receive at least part of the liquid reservoir portion detection element and the engaging element is adapted to engage with the liquid reservoir portion detection element when the liquid reservoir portion is coupled with the power supply/atomizer portion, and wherein the liquid reservoir portion detection element is adapted, when the liquid reservoir portion is coupled with the power supply/atomizer portion, to engage with the engaging element so as to be moved from the first position to the second position, thereby operating the activation element.

2. The electronic smoking device according to claim 1, wherein the liquid reservoir portion detection device further comprises a resilient element that is adapted to push the liquid reservoir portion detection element toward the first position.

3. The electronic smoking device according to-claim 1, wherein the engaging element is configured to be destructed upon engagement with the liquid reservoir portion detection element when the liquid reservoir portion is coupled with the power supply/atomizer portion.

4. The electronic smoking device according to claim 3, wherein the engaging element is adapted, before being destructed, to withstand a pressure load that is exerted by the liquid reservoir portion detection element, which pressure load is sufficiently high so as to move the liquid reservoir portion detection element from the first position toward the second position against the pressure load provided by the resilient element.

5. The electronic smoking device according to claim 1, wherein the engaging element is a cover element that covers the opening of the cavity.

6. The electronic smoking device according to claim 5, wherein the cover element is a foil element.

7. The electronic smoking device according to claim 6, wherein the liquid reservoir portion detection element is a pin having a tip portion that is adapted to pierce the foil element when the liquid reservoir portion is coupled with the power supply/atomizer portion.

8. The electronic smoking device according to claim 1, further comprising an air duct in communication with the atomizer to guide atomized liquid toward an inhalation port of the electronic smoking device, wherein at least part of the air duct is provided inside the liquid reservoir portion.

9. The electronic smoking device according to claim 8, wherein the liquid reservoir extends in a longitudinal direction of the liquid reservoir portion, the cavity is provided on one side of the liquid reservoir, and the part of the air duct that is provided in the liquid reservoir portion is provided on the other side of the liquid reservoir to extend in the longitudinal direction of the liquid reservoir portion toward the inhalation port.

10. The electronic smoking device according to claim 1, further comprising an airflow sensor, and control electronics electrically connected with the activation element and the airflow sensor, wherein the airflow sensor is adapted to detect a user puffing on the electronic smoking device and the control electronics is adapted to increment a dose counter based on a puff detected by the airflow sensor and to reset the dose counter when the activation element is operated.

11. The electronic smoking device according to claim 10, wherein the airflow sensor is configured to detect a pressure drop in the electronic smoking device and to provide a pressure drop signal to the control electronics that includes duration information specifying the duration of the pressure drop.

12. The electronic smoking device according to claim 11, wherein the control electronics is configured to determine the duration of the puff based on the pressure drop signal provided by the airflow sensor and to control power supply to the atomizer and/or to increment the dose counter according to the duration of the puff.

13. A power supply/atomizer portion for an electronic smoking device, the power supply/atomizer portion comprising:

a power supply and an atomizer adapted to atomize the liquid stored in a liquid reservoir when operated by the power supply;

a liquid reservoir portion detection element that is moveable between a first position and a second position; and an activation element that is adapted to be operated by the liquid reservoir portion detection element when the liquid reservoir portion detection element is moved from the first position to the second position.

14. A liquid reservoir portion for an electronic smoking device, the liquid reservoir portion comprising:

a liquid reservoir storing a liquid;

an empty cavity including an opening that is adapted to receive at least part of a liquid reservoir portion detection element of a power supply/atomizer portion for the electronic smoking device; and an engaging element adapted to engage with the liquid reservoir portion detection element when the liquid reservoir portion is coupled with the power supply/atomizer portion, wherein the opening of the cavity is at least partially blocked by the engaging element when the liquid reservoir portion is decoupled from the power supply/atomizer portion of the electronic smoking device;

wherein the liquid reservoir portion detection element is adapted, when the liquid reservoir portion is coupled with the power supply/atomizer portion, to engage with the engaging element so as to be moved from the first position to the second position, thereby operating an activation element of the power supply/atomizer portion.

15. A method for detecting the coupling of a power supply/atomizer portion for an electronic smoking device with a replaceable liquid reservoir portion for an electronic smoking device, the method comprising:

providing the power supply/atomizer portion and the replaceable liquid reservoir portion, wherein the liquid reservoir portion is coupleable with the power supply/atomizer portion, wherein:

the power supply/atomizer portion comprises a liquid reservoir portion detection element that is moveable between a first position and a second position, and an activation element that is adapted to be operated by the liquid reservoir portion detection element when the liquid reservoir portion detection element is moved from the first position to the second position, the liquid reservoir portion comprises a cavity and an engaging element, wherein the cavity is empty and an opening of the cavity that faces the power supply/atomizer portion when the liquid reservoir portion is coupled with the power supply/atomizer portion is at least partially blocked by the engaging element as long as the liquid reservoir portion is not coupled with the power supply/atomizer portion, the cavity is adapted to receive at least part of the liquid reservoir portion detection element and the engaging element is adapted to engage with the liquid reservoir portion detection element when the liquid reservoir portion is coupled with the power supply/atomizer portion, and the liquid reservoir portion detection element is adapted, when the liquid reservoir portion is coupled with the power supply/atomizer portion, to engage with the engaging element so as to be moved from the first position to the second position, thereby operating the activation element, coupling the power supply/atomizer portion with the liquid reservoir portion, wherein, while coupling the power supply/atomizer portion with the liquid reservoir portion, the liquid reservoir portion detection element of the power supply/atomizer portion engages the engaging element of the liquid reservoir portion and is moved from the first position to the second position, thereby operating the activation element; and detecting the coupling based on the operation of the activation element.

* * * * *